US005324230A

United States Patent [19]

Hist

[11] Patent Number: 5,324,230

[45] Date of Patent: Jun. 28, 1994

[54] PORTABLE ROOM HUMIDIFIER

[76] Inventor: L. Frank Hist, Rte. 1 Box 12, Winterville, Ga. 30683

[21] Appl. No.: 74,531

[22] Filed: Jun. 11, 1993

[51] Int. Cl.[5] ..... F24F 6/04

[52] U.S. Cl. ..... 454/328

[58] Field of Search ..... 454/293, 328, 337

[56] References Cited

U.S. PATENT DOCUMENTS

| | | | |
|---|---|---|---|
| 27,461 | 3/1860 | McNeill | 454/328 X |
| 170,990 | 12/1875 | Colburn | 454/328 |
| 310,116 | 12/1884 | Beale | 454/328 X |
| 435,095 | 8/1890 | Hilyer . | |
| 835,542 | 11/1906 | Leyerle . | |
| 1,250,280 | 12/1917 | Carpenter | 454/328 X |
| 1,778,441 | 10/1930 | Weir | 454/328 |
| 3,227,064 | 1/1966 | Spangle | 454/328 |
| 3,254,841 | 6/1966 | De Loncker, Sr. . | |
| 4,307,656 | 12/1981 | Vesper | 454/328 |

*Primary Examiner*—Harold Joyce

*Attorney, Agent, or Firm*—Wigman, Cohen, Leitner & Myers

[57] ABSTRACT

A portable room humidifier includes a magnetic mounting structure for mounting the humidifier to a forced convection air register. A compact and lightweight water reservoir replenishes water supply by capillary action to a wicking material which is vertically suspended by a compact support structure in opposing relationship to an air stream flowing from the air register. The wicking material is comprised of readily-available, low cost, highly-water-absorbent fabric. The mounting hardware is configured to be completely contained within the water reservoir for compact, lightweight transport.

19 Claims, 2 Drawing Sheets

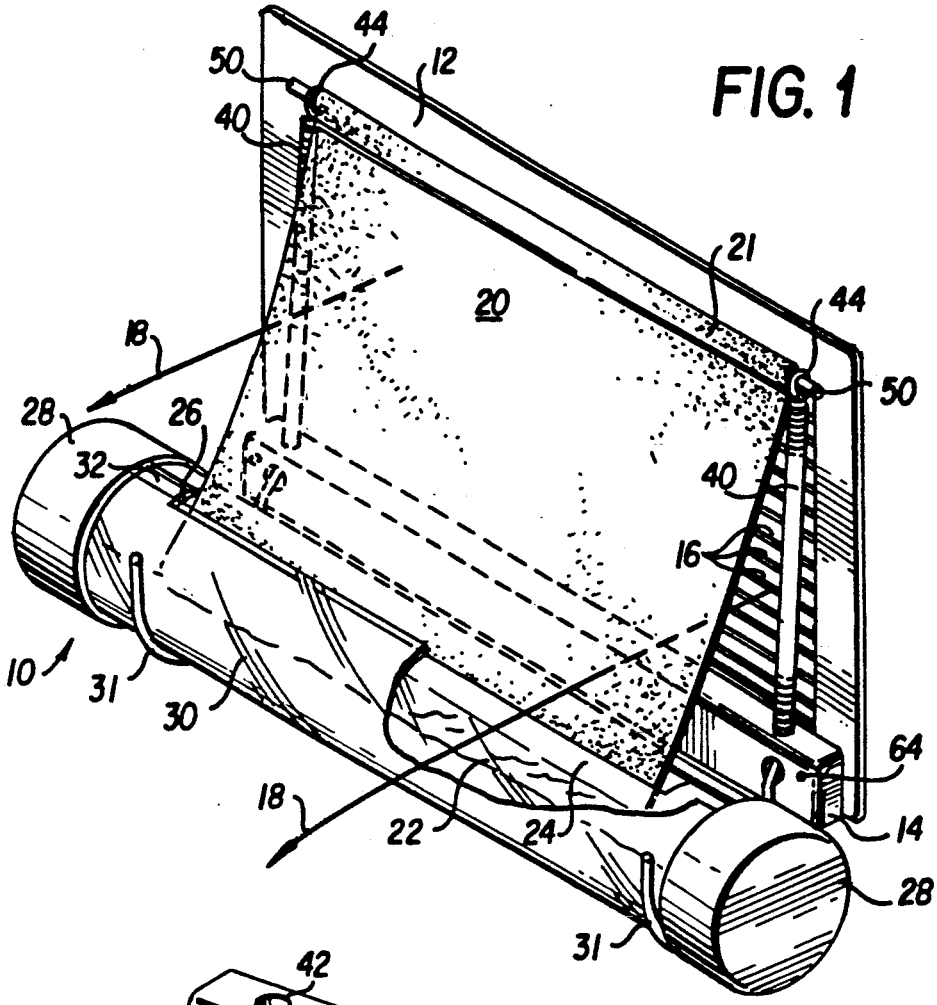
FIG. 1
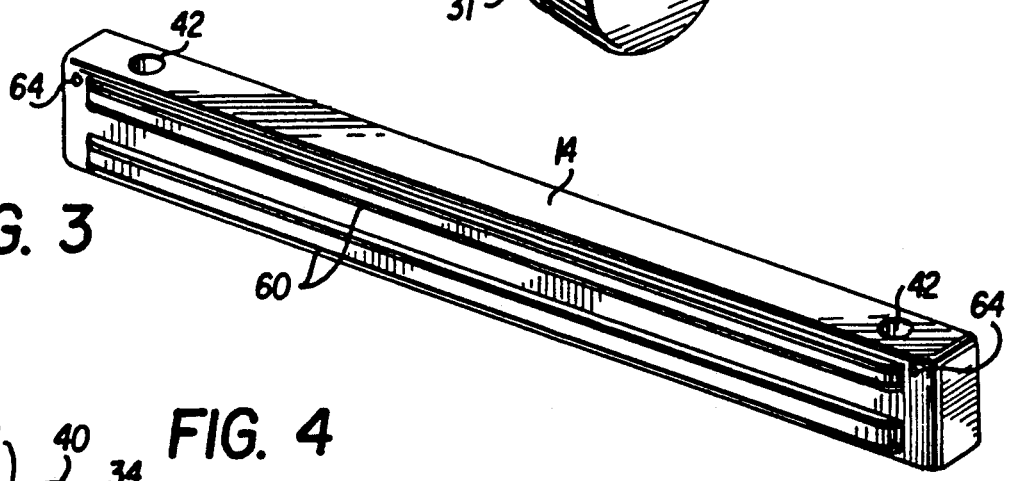
FIG. 3
FIG. 4
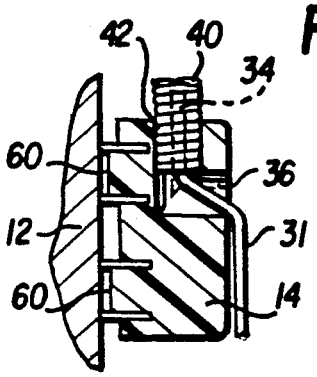
FIG. 5
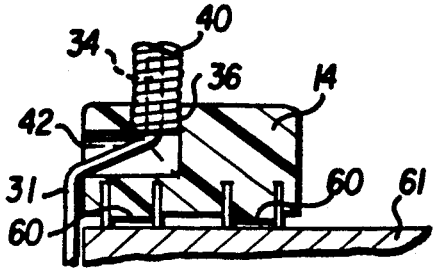

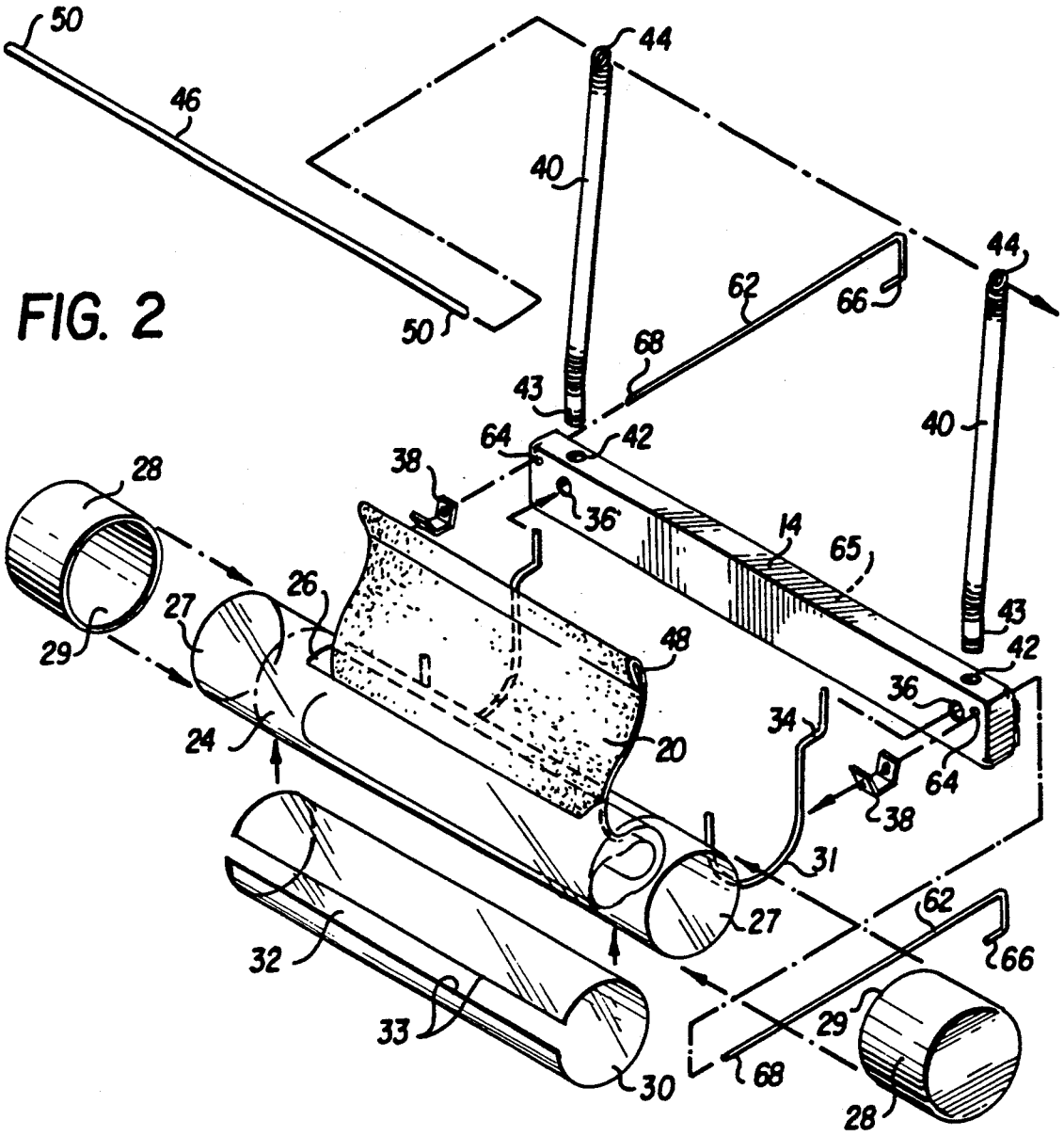
FIG. 2
FIG. 6
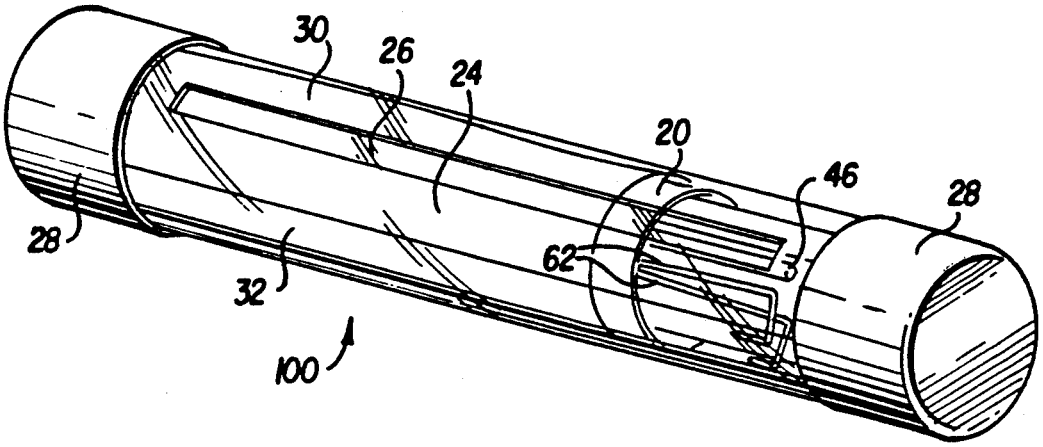

PORTABLE ROOM HUMIDIFIER

FIELD OF THE INVENTION

The present invention relates to portable room humidifiers, and more particularly to a portable room humidifier which can be transported in a self-contained kit form and which is adapted to be removably mounted to an air supply register of a forced air heating system.

BACKGROUND OF THE INVENTION

Without humidification, many enclosed buildings experience undesirably low humidity levels, especially during the heating season. This is due in part to the low humidity ratios of outdoor air supplied to widely-used forced air heating systems, as well as the electrically resistive heating systems found in many hotel, office, and commercial buildings. Significant problems are associated with low humidity environments, including aggravation of existing respiratory problems, and an undesirably high static electricity buildup in carpeting, other room furnishings, and clothing. It is well known that conditioned air should be humidified within a relatively narrow humidity range to achieve an acceptable human comfort level at a particular temperature and atmospheric pressure. It is also well known that uncontrolled discharge of such static electricity buildup may result in significant damage to electronic equipment such as computers and their storage and operating components.

Some forced air heating systems include the type of humidifier which admits steam directly into the supply airstream and the resulting conditioned airflow is then delivered through a supply air duct to a supply air register in selected rooms in the building. However, not all buildings or rooms are so equipped, and in those buildings that are, the heating system humidifier may be incorrectly set to too low a humidity ratio or otherwise nonfunctional. Alternatively, many buildings provide zoned or local heating systems which have no provision for an integrated humidifier.

In particular, many hotel and motel rooms are provided with individual forced air heating systems or resistive-type electrical heaters, both types of heating systems generally operating without a humidifier. Some of these systems have a through-the-wall configuration extending into the room with a horizontal top-surface air register, while other systems are integrated into the wall and discharge an air flow through a vertical air register.

Heretofore, a compact, relatively portable humidifier for use under such conditions, and especially for use by itinerant occupants, has not been successfully achieved. For example, a water evaporator disclosed in U.S. Pat. No. 435,095 provides an open water receptacle detachably affixed by a pair of brackets to the reticulated grill of a hot air register. With one end of a wicking cloth being submerged in the water receptacle, the remaining length of the cloth is suspended from a suspension rod extending above the water receptacle.

Another evaporator disclosed in U.S. Pat. No. 835,542 provides an open water receptacle similar to that of U.S. Pat. No. 435,095, further including a roller mechanism used to suspend, extend, and retract a wicking cloth overhanging the front side of the water receptacle. An important problem common to both approaches is that there is a great variety of hot air register grill configurations with vertical and horizontal orientations, many of which are not designed to accommodate the brackets of these apparatus. Another important problem is that the configuration of the water receptacles and brackets affixed thereto is relatively large and cumbersome, thereby creating a strong disincentive to portability and use by most travelers.

SUMMARY OF THE INVENTION

In view of the foregoing limitations and shortcomings of the prior art devices, as well as other disadvantages not specifically mentioned above, it should be apparent that there still exists a need in the art for a portable room humidifier which can be easily transported from place to place and readily assembled and installed without difficulty. It is, therefore, a primary object of this invention to fulfill that need by providing a portable room humidifier which is readily and easily transported in a kit form by a person especially for temporary use in a room to be humidified.

It is another object of the present invention to provide a portable room humidifier which is selectively detachable to an air register in a particular room which is to be humidified, without requiring alteration of any room fixtures.

It is another object to provide a portable room humidifier that can be readily assembled, installed, and disassembled without the use of any tools.

It is another object of the invention to provide a portable room humidifier device in a kit in which all the components of the humidifier device can be packaged in a self-contained form for ease of transport.

It is a further object of the present invention to provide a portable room humidifier which includes a magnetic attachment means for attachment to the air registers commonly utilized in many forced air heating and cooling systems.

It is yet another object of the present invention to provide a readily available, replaceable, and low-cost wicking material for use with the portable room humidifier of the present invention.

The present invention provides a portable humidifier which is adapted to be mounted to a forced air register through which a conditioned (heated) air flow is passed. The humidifier includes a compact and lightweight water reservoir, and a wicking material initially immersed therein. The humidifier is removably affixed by a plurality of support brackets to a magnetic mounting structure, which is configured to be magnetically affixed to a vertical or horizontal surface of a steel register. The reservoir, which is constructed of transparent tubular material to enable monitoring of the water supply, has a pair of removable end caps which provide a water seal at the end of the reservoir and permit packaging of all the components of the humidifier in the reservoir. The reservoir is removably affixed to the support brackets to enable replenishment of the water supply and, optionally, addition of an air freshening fragrance to the water supply. The wicking material is comprised of readily-available, low cost, highly-water-absorbent fabric. The wicking material is drawn upward through a longitudinal slot in the reservoir, and suspended in an extended position by a wick support rod held in parallel orientation to the water reservoir by a pair of support rods extending upwardly from the magnetic mounting structure.

In the installed condition, the magnetic mounting structure is positioned immediately below or adjacent to the louvers or vents of a vertical or horizontal register, respectively, with the suspended wicking material held in opposing relationship to the air stream flowing from the register. Capillary action causes a continuous replenishment of the moisture driven from the wicking material during room humidification. For installation on plastic or nonmagnetic metal registers or surfaces, the magnetic mounting structure is supported by a pair of hook-like support rods, which are engagable, for example, with the louvers of a register. When the humidifier is to be transported, either of the two end caps is removed from the reservoir, any remaining water is removed, and the mounting hardware is fitted therein, together with the wicking material, to consolidate the humidifier in a single, compact package. A longitudinally slotted sleeve is rotatably and slidably fitted over the reservoir in a telescoping manner so as to close the reservoir slot, thereby providing a relatively watertight enclosure which is readily transported in a suitcase. In use, the slot of the sleeve is rotated to align with the wick slot in the reservoir.

With the foregoing and other objects, advantages and features of the present invention that will become hereinafter apparent, the nature of the invention may be more clearly understood by reference to the following detailed description of the invention, the appended claims, and to the several views illustrated in the attached drawings.

BRIEF DESCRIPTION OF THE DRAWINGS

FIG. 1 is a perspective view of a portable room humidifier shown magnetically mounted to an air supply register of a forced air heating and cooling system;

FIG. 2 is an exploded view of the portable room humidifier, showing the individual components of the humidifier and various support structures for magnetically and mechanically affixing the humidifier to a selected air supply register, and further showing the humidifier wick in an extended position for maximum humidification;

FIG. 3 is a perspective view of the reverse side of the mounting bar of the portable room humidifier, showing the magnetic strips provided therein; and FIG. 4 is a cross-sectional view of the mounting bar of the portable room humidifier, showing the mounting bar mounted to a vertical surface and a water reservoir support bracket and an upwardly extending wick support rod assembled thereto;

FIG. 5 is a cross-sectional view of the mounting bar of the portable room humidifier, showing the mounting bar mounted to a horizontal surface and a water reservoir support bracket and an upwardly extending wick support rod assembled thereto;

FIG. 6 is a perspective view showing all the components of the portable room humidifier packaged in a compact kit form in the reservoir tube.

DETAILED DESCRIPTION OF THE INVENTION

Referring now in detail to the drawings wherein like parts are designated by like reference numerals throughout, there is illustrated in FIG. 1 a portable room humidifier 10 secured in a fully assembled condition to an air supply register 12 by a magnetic support bar 14. The air register 12 includes a plurality of air vents or louvers 16 through which an air supply shown by the arrows 18 is flowed in the direction of a suspended wicking material 20. The wicking material 20 is saturated by a water supply 22 contained within a tubular water reservoir 24 sealed at its ends by a pair of end caps 28. Optionally, an air freshening fragrance may be added to the water supply 22. The wicking material or wick 20 is preferably a disposable, high-capillary action non-woven fabric such as a paper fabric. Suitable fabrics include the non-woven fabric identified by Stock No. 160 manufactured by Cadie Products Corporation, Paterson, N.J. and the HANDI WIPES® brand of cloth towels available in many retail stores. The wick 20 is sized to allow for a section thereof, such as the bottom 2–3 inches of its length, to remain immersed in the water 22 in the water reservoir 24 so that the entire wick remains saturated by capillary action during the normal operation of the humidifier 10, i.e., when the exposed portion of the wick 20 is extended to its fully suspended condition. The uppermost end of the wick 20 is overlapped and secured, e.g. by sewing, into a sleeve or pocket 21 extending along the full width of the wick 20.

More particularly, and with further reference to FIG. 2, the water reservoir 24 is comprised of an open-ended plastic cylinder having a longitudinal slot 26 extending therealong, and terminating short of the reservoir ends 27. The end caps 28, which are made of a flexible material such as rubber or plastic, are removably and sealingly affixed to the reservoir ends 27, but do not extend over the end portions of the longitudinal slot 26. An open-ended sleeve 30 having a longitudinal slot 32 defined by edges 33 and extending the full length of sleeve 30 is fitted to the reservoir 24 with a circumferentially sliding fit. The sleeve 30 is thus rotatable about the axis circumferentially of the reservoir 24 so as to fully overlap and enclose the slot 26. Preferably, the sleeve 30 has a length slightly less than the distance between the circular edges 29 of the end caps 28 so as to be easily rotatable. During operation of the humidifier 10, the wick 20 is drawn partially through and extends upwardly and outwardly from the longitudinal slot 26 in a manner to be more fully described below.

The water reservoir 24 is removably affixed to the magnetic support bar 14 by a pair of semicircular brackets 31 each having an L-shaped end portion 34 configured to be received in a recess 36 formed at either end of the magnetic bar 14. The brackets 31 are sized to accept the water reservoir 24 with a snug, but readily adjustable and removable fit and are securely held in place by the weight of the reservoir 24. A pair of wick support brackets 40 is received in a respective bore 42 formed in the top surface of the magnetic support bar 14, the bores 42 being at right angles to and contiguous with the bracket recesses 36. The brackets 40 are comprised of hollow rods preferably formed of a coiled steel spring wire, e.g., of the type used as a biasing spring on a screen door or the like.

Each bracket 40 has a lower leg portion 43 preferably bent at about a 30 degree angle, to provide an offset sufficient to bring the extended wick material 20 into close proximity with the face of the air supply register 12 in the fully assembled and installed condition as best seen in FIG. 1. The brackets 40 also include upper loop portions 44 through which a wick support rod 46 is slidably received. Prior to slidable engagement of the wick support rod 46 through the loop portions 44, the rod 46 is threaded through the opening 48 in the sleeved end section 21 of the wicking material 20. In this condition, end portions 50 of the wick support rod 46 are engaged with the loop portions 44.

The humidifier is affixable to an air register 14 by either of two attachment systems. Referring to FIG. 3, the magnetic attachment system includes longitudinally-extending magnetic strips 60 which are embedded in the vertical face of the magnetic support bar 14 opposite the face thereof containing the recesses 36. The assembly of the magnetic support bar 14 with the embedded magnetic strips 60 is commercially available from Magnagrip Division of Blue Ray Inc., Essex, Conn.

Assembly of the end portion 34 and the lower leg portion 43 to the support bar 14 is more fully shown in FIG. 4. When the humidifier 10 is to be magnetically mounted to vertical surface of the air register 12, the support 14 is turned to allow the end portion 34 to be passed through the now-horizontal bracket recess 36 to project vertically upwardly through the now-vertical bore 42. The lower leg portion 43 then is lowered over the end portion 34 and inserted into the vertical bore 42. The humidifier 10 is magnetically mounted to an air register having a horizontal surface 61 by reorienting the support bar 14, end portion 34, and lower leg portion to the configuration shown in FIG. 5. In particular, the end portion 34 is passed through the now-horizontal bore 42 to project vertically upwardly through the now-vertical bracket recess 36. The lower leg portion 43 of the wick support bracket 40 is then lowered over the end portion 34 and inserted into the bracket recess 36.

For a non-magnetic attachment system, a pair of horizontal support rods 62 (FIG. 2) support and suspend the humidifier 10 from an air register opening or the grill of an resistive-type electrical heater (not shown). In particular, each support rod 62 includes a hook section 66 and an insertion section 68 to be received in throughbores 64 in the magnetic support bar 14. After the desired connection of the support rods 62 and adjustment relative to the support bar 14 has been achieved, each support rod 62 is secured to the magnetic support bar 14 by a spring clip 38 slidably received on the insertion portion 68 and positioned to lock the magnetic support bar 14 to the air register 12.

According to the invention, either attachment system is quickly and easily adjusted as necessary to allow for other than the substantially vertical installation shown in FIG. 1. For example, the humidifier 10 may be installed in a horizontal configuration to accommodate a horizontally positioned air register (not shown). In this configuration, the water reservoir 24 is rotated 90 degrees within the brackets 31 so that the longitudinal slot 26 remains in an upper position, thereby preventing spillage of the water supply 22 contained therein. Also, the magnetic strips 60 may be sized and magnetized to enable magnetic affixation of the humidifier to a horizontal ceiling air register (also not shown).

Alternatively, the humidifier 10 may be installed diagonally or otherwise to accommodate other architectural constraints, as will be appreciated by the seasoned traveler and others to whom use of the present invention is directed. In any of these configurations, however, the water reservoir 24 is adjusted as necessary to prevent spillage of the water supply 22. Likewise, the wicking material 20 is brought into closer proximity with the face of the air supply register 12 by adjustment of the angle of the lower leg portion 43 of the brackets 40. Such adjustment may be within a range of 15 to 45 degrees, or as required to provide the offset sufficient to fully expose the wick 20 to the airflow 18.

With reference now to FIG. 6, the portable room humidifier of the present invention is shown disassembled and packaged in a self-contained kit 100, ready for transport. In particular, when the humidifier 10 is to be transported, either of the two end caps 28 is removed from the water reservoir 24, any remaining water is removed, and the mounting hardware is fitted therein, optionally together with the damp wick 20, to consolidate the portable room humidifier in a single, compact kit or package. For ease of packaging, the magnetic bar 14 and metal components are bundled together, overwrapped with the wick 20, and fully inserted through the opened reservoir end 27 into the reservoir 24. The end cap 28 is then sealingly reaffixed to that reservoir end 27, and the sleeve 30 is closed over the reservoir slot 32, thereby providing a substantially moisture-tight enclosure which is now ready for transport.

Although a preferred embodiment of the portable room humidifier of the present invention has been described herein and fully illustrated by the drawing figures, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A portable humidifier for use with a forced air ventilation system having an air register through which an airflow passes, comprising:

a tubular water reservoir for receiving a water supply, said reservoir having at least one open end, a removable end cap adapted to be sealingly affixed to the open end of the water reservoir, and a slot extending along the longitudinal extent of the water reservoir;

a wick having a first end adapted to be immersed in the water supply in said reservoir and a second end extendable through said slot;

means for removably affixing the water reservoir adjacent to said air register of said ventilation system; and means for suspending the extended wick in opposing relationship to the airflow passing through said air register.

2. The portable humidifier of claim 1, further comprising an open-ended sleeve having a slot extending along the full longitudinal extent thereof, said sleeve being circumferentially rotatable about the water reservoir, said sleeve slot substantially coinciding with said water reservoir slot in an open slot position, said sleeve being rotatable over said water reservoir slot in an overlapping manner into a closed slot position.

3. The portable humidifier of claim 1, wherein the water reservoir comprises a cylindrical tubular member made of a transparent plastic material for viewing the water supply level.

4. The portable humidifier of claim 1, wherein said water reservoir includes two open ends and an end cap sealingly affixed to each of said ends.

5. The portable humidifier of claim 4, wherein the water reservoir slot terminates short of the reservoir ends.

6. The portable humidifier of claim 2, wherein said sleeve comprises a transparent material having a longitudinal extent greater than the water reservoir slot.

7. The portable humidifier of claim 1, wherein the wick comprises a disposable non-woven fabric material.

8. The portable humidifier of claim 1, wherein the affixing means comprises a magnetic support bar and a pair of bracket means each having a shaped end portion removably affixed to said magnetic support bar at a pair of recesses formed therein for receiving and securing the water reservoir thereto, said magnetic support bar being magnetically affixable to a ferromagnetic support.

9. The portable humidifier of claim 8, wherein the magnetic support bar comprises at least one longitudinally-extending magnetic strip embedded in a face thereof.

10. The portable humidifier of claim 8, wherein each support bracket means includes a semicircular portion shaped to receive the water reservoir, and an L-shaped portion to be received by a respective one of said recesses.

11. The portable humidifier of claim 1, wherein the affixing means comprises a support bar and a pair of bracket means removably affixed to said support bar at a pair of recesses formed therein for receiving and securing the water reservoir thereto, and the suspending means comprises a pair of support brackets removably affixed to said support bar through a pair of through-bores formed therein for suspending the extended wick in opposing relationship to the airflow passing through said air register.

12. The portable humidifier of claim 1, wherein the wick suspending means comprises a pair of wick support brackets removably mounted to said affixing means, a rod extending between said wick support brackets and being removably affixed thereto, the second end of said wick being suspended from said rod.

13. The portable humidifier of claim 12, wherein each wick support bracket is bent within a range of about 15 degrees to about 45 degrees relative to its longitudinal axis to offset the wick into close proximity with the airflow.

14. The portable humidifier of claim 12, wherein each wick support bracket comprises a coiled steel spring wire.

15. The portable humidifier of claim 12, wherein each wick support bracket comprises a loop portion affixed to one end thereof, said rod extending through the loop portion of each bracket.

16. A portable room humidifier kit, comprising:

a cylindrical water reservoir, a pair of removable end caps adapted to be removably and sealingly affixed to the ends of the water reservoir, and a first slot extending along the longitudinal extent of the water reservoir;

an open-ended sleeve having a second slot extending-along the full longitudinal extent thereof, said sleeve being circumferentially rotatable about the water reservoir to a closed position over said first slot in an overlapping manner to close said first slot;

a wick;

means for removably affixing the water reservoir, sleeve, and wick to an air register of a forced air ventilation system; and means for suspending said wick from said reservoir;

said affixing means, said suspending means, and said wick being adapted to be fully received and contained in said water reservoir, with said end caps affixed to the ends of the reservoir and said sleeve rotated to the closed position whereby said kit comprises a substantially moisture-tight, unitary package.

17. The kit of claim 16, wherein said affixing means comprises a magnetic support bar.

18. The kit of claim 16, wherein said reservoir and said sleeve are made of a transparent plastic material.

19. The kit of claim 16, wherein said wick comprises a disposable non-woven fabric material.

* * * * *